US006097294A

United States Patent [19]

Hilton

[11] Patent Number: 6,097,294

[45] Date of Patent: Aug. 1, 2000

[54] INFANT PROTECTIVE SAFETY SUPPORT WITH INDICATING MEANS

[76] Inventor: David D. Hilton, 1108 Cool Springs Dr., Kennesaw, Ga. 30144

[21] Appl. No.: 09/376,928

[22] Filed: Aug. 18, 1999

[51] Int. Cl.[7] ..... G08B 23/00

[52] U.S. Cl. ..... 340/573.1; 340/573; 340/575.1; 5/655; 604/361

[58] Field of Search ..... 340/573, 573.1, 340/575, 686, 286; 5/655, 494; 604/361; 446/77; 310/36

[56] References Cited

U.S. PATENT DOCUMENTS

| | | | |
|---|---|---|---|
| 3,708,808 | 1/1973 | Irby | 5/95 |
| 3,844,471 | 10/1974 | Hind | 229/30 |
| 3,924,282 | 12/1975 | Bond | 5/327 R |
| 4,030,719 | 6/1977 | Gabriele et al. | 269/328 |
| 4,383,713 | 5/1983 | Roston | 297/219 |
| 4,411,034 | 10/1983 | Williams | 5/494 |
| 4,434,513 | 3/1984 | Welch | 2/410 |
| 4,441,221 | 4/1984 | Enste et al. | 5/431 |
| 4,516,282 | 5/1985 | Topalian et al. | 5/72 |
| 4,584,730 | 4/1986 | Rajan | 5/431 |
| 4,648,142 | 3/1987 | Bruning | 5/93 R |
| 4,733,836 | 3/1988 | Barnes | 248/106 |
| 4,744,117 | 5/1988 | Bond | 5/431 |
| 4,771,493 | 9/1988 | Park | 5/437 |
| 4,783,865 | 11/1988 | Stotler | 5/424 |
| 4,788,726 | 12/1988 | Rafalko | 5/93 R |
| 4,958,393 | 9/1990 | Brecher | 5/431 |
| 5,014,376 | 5/1991 | Doran et al. | 5/431 |
| 5,056,533 | 10/1991 | Solano | 128/845 |
| 5,057,819 | 10/1991 | Valenti | 340/573 |
| 5,189,748 | 3/1993 | Garrison et al. | 5/655 |
| 5,260,684 | 11/1993 | Metzmaker | 340/457.1 |
| 5,261,133 | 11/1993 | Wilkerson | 5/655 |
| 5,272,780 | 12/1993 | Clute | 5/655 |
| 5,357,642 | 10/1994 | Clute | 5/655 |
| 5,367,730 | 11/1994 | Sher | 5/655 |
| 5,822,817 | 10/1998 | Carew et al. | 5/732 |
| 5,842,901 | 12/1998 | Montgomery | 446/77 |
| 5,861,686 | 1/1999 | Lee | 310/36 |
| 5,908,411 | 6/1999 | Matsunari | 604/361 |

*Primary Examiner*—Jeffery A. Hofsass
*Assistant Examiner*—Phung Nguyen
*Attorney, Agent, or Firm*—Hughes & Kaplan; Barry E. Kaplan, Esq.

[57] ABSTRACT

An adjustable infant protective safety and support device is disclosed having one or more covered, foam barriers detachably and adjustably mounted with hook and loop fasteners upon a cloth base. Affixed to each foam barrier is an activation bar and microswitch combination. This combination, when connected in an electrical circuit with one or more warning devices, act to awaken a sleeping adult lying alongside of the infant should the adult roll into contact with the device. Alternatively, the activation bar and microswitch combination may be reversed to face the infant in order to warn an adult that the child is moving in contact with the barrier. Desirable optional features for the infant protective safety support device include both audible and vibratory warning modes of operation.

17 Claims, 2 Drawing Sheets

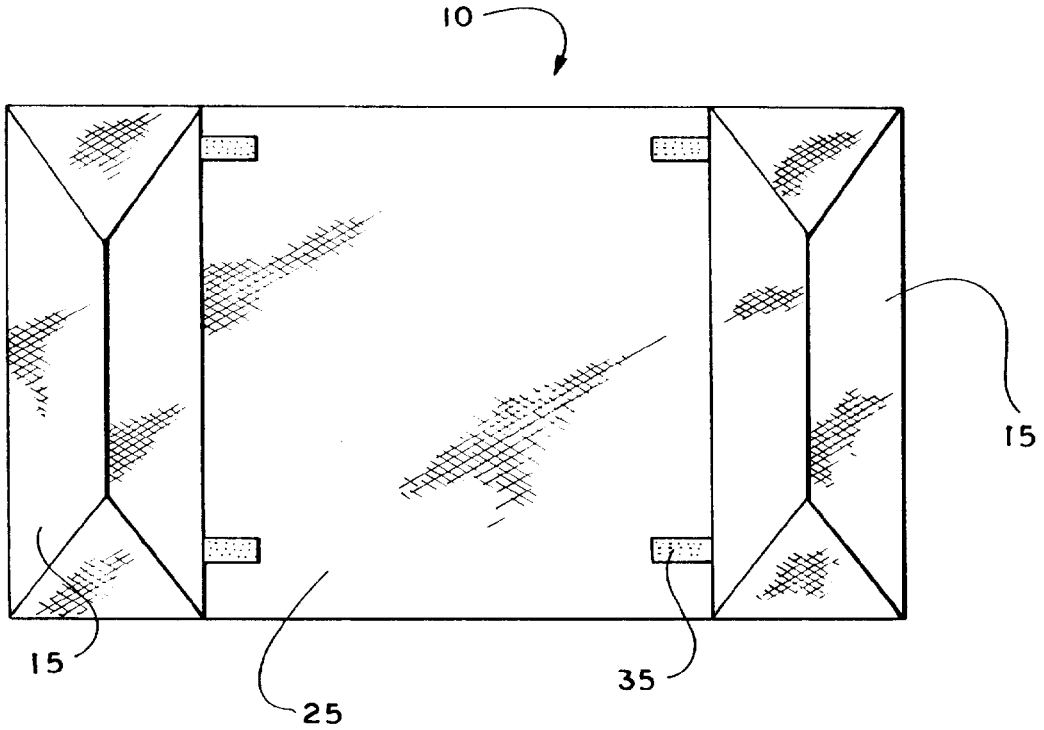
Fig. 3
Fig. 4
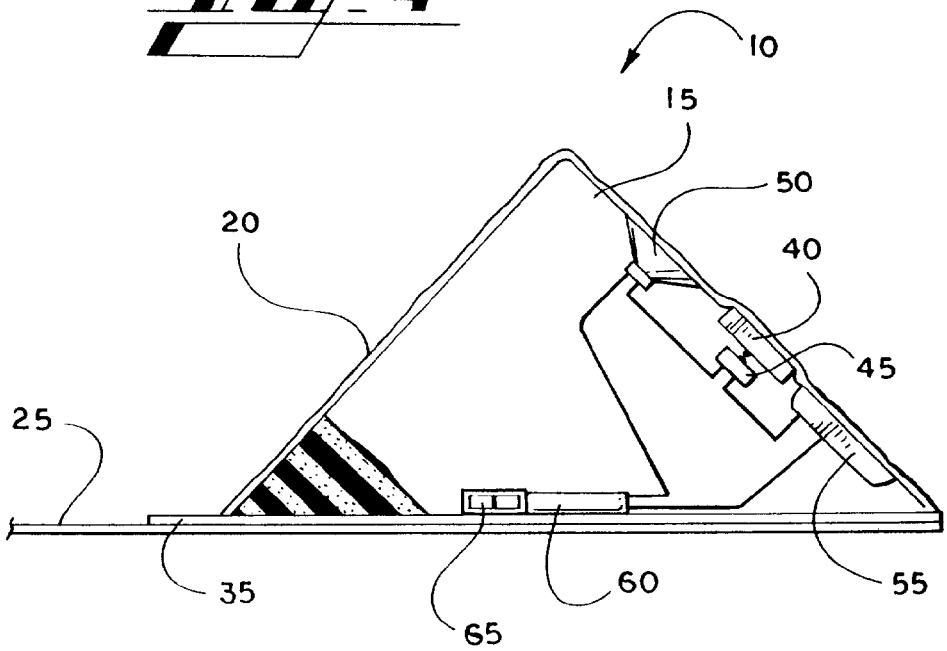

INFANT PROTECTIVE SAFETY SUPPORT WITH INDICATING MEANS

BACKGROUND OF THE INVENTION

1. Field of the Invention

The present invention relates generally to sleeping devices intended to position and protect an infant during sleep. More particularly, the present invention provides a device intended to position and protect an infant during sleep from the danger of a sleeping adult rolling over upon the child and causing injury thereby. Additionally, the present invention is provided with notification means to alert a sleeping adult that the child is in danger, or, alternatively, to alert an adult that the child has awakened.

2. Description of Related Art

There is little quite so satisfying to a new parent as to rest with a newborn child. This activity allows the parent to bond with the newborn child and generally enhances the parent-child relationship from a very early age. It, thus, has been the practice throughout history for parents to sleep alongside of their infant children. It has been well documented, however, that this practice is detrimental, and sometimes deadly, for the infant child. There have been numerous instances, for example, wherein a sleeping parent has rolled over upon the child, thereby unknowingly suffocating the child. Oftentimes, the infant is seriously injured by the weight of the sleeping adult.

It has been further recognized that certain sleeping positions are better suited for the health and safety of the child. In fact, studies have suggested that the position of a sleeping infant may be one factor contributing to Sudden Infant Death Syndrome, commonly known as SIDS. Certain studies have indicated that it is most healthful for an infant child to sleep in a propped position upon its side, rather than upon its back or stomach.

Additionally, it has long been the practice of parents to place various barriers, including pillows or cloth rolls, alongside of an infant child. These barriers are intended to constrain the movement of the infant and to further prevent the infant from rolling off of a bed or changing table and, thereby, injuring itself. These barriers, however, may present a suffocation hazard to the infant if the infant pushes his nose into the soft barrier.

In recognition of one or more of the above-referenced hazards, various devices have been developed. For example, U.S. Pat. No. 3,708,808 to Irby and U.S. Pat. No. 4,648,142 to Bruning disclose infant restraining devices. U.S. Pat. No. 4,434,513 to Welch discloses an infant head protector, while U.S. Pat. No. 4,783,865 to Stotler discloses an infant nestling barrier. U.S. Pat. No. 5,189,748 to Garrison et al. discloses an infant side support sleeping device. Although exemplary of the relevant art, none of these devices successfully has provided a solution to the varied problems noted above.

Accordingly, it would be desirable to provide an infant protective safety support device capable of constraining and supporting the infant child in a recommended sleeping position, while providing a means of warning a sleeping adult that (s)he is about to contact or roll over upon the infant. It would be further desirable to awaken the sleeping adult before (s)he contacts or rolls over upon the infant so as to prevent injury to the infant. It would also be desirable to warn the adult without awakening the infant. Additionally, it would be desirable to provide a device capable of notifying an adult, who may not be present in the room, that the infant has awakened and is moving about. It is, therefore, to these ends that the present invention has been developed.

BRIEF SUMMARY OF THE INVENTION

Briefly described, in a preferred embodiment, the present invention both overcomes the above-mentioned disadvantages, and meets the recognized needs for such device, by providing an infant protective safety support device which has two indicating modes of operation. The device is comprised of a plurality of soft barriers, preferably of triangular cross-section, and preferably constructed of foam rubber, encased in fabric. Cutouts are provided within a side of each barrier for affixation of microswitches. Proximate to each barrier, bridging the microswitches, is an activation bar, preferably of rigid plastic or similar material. Additional cutouts are provided within a side of each barrier for affixation of a warning indicator means in the nature of a vibrating mechanism, chime speaker, battery, and an electrical switch for converting between chime and vibration modes of operation. Also provided is a fabric base to which the barriers may be removably affixed. Affixed to the base of each barrier are hook fasteners, each of which removably engages a cooperating loop fastener strip which is affixed upon the cloth base of the device.

In a first operating configuration, an audible warning is selected by the parent. The barriers are suitably positioned upon the fabric base at a desired width, with the activation bars adjacent to the infant, and then the barriers are pressed into position through alignment of the cooperating hook and loop fasteners.

When the infant starts to awaken and move about, it will contact the activation bar upon one of the barriers; thereby, activating the warning indicator means and notifying the adult that supervision is required. Although the infant generally is restrained between the barriers until the adult removes the infant from the device, the warning indicator means assures the attentive parent that the infant is not left to thrash about upon the bed and work its way out of the device. In this way, the safety of the child is better ensured.

In a second operating configuration, the barriers are positioned such that the activation bars face outwardly, away from the partial enclosure formed by the barriers. The vibrating mode of operation, which will not generally awaken a sleeping infant, is selected by the parent. In this mode of operation, an adult sleeping or otherwise resting alongside of the infant will contact an activation bar upon one of the barrier restraints when the adult rolls or moves toward the infant. The adult, thereby, will activate the warning indicator and awaken without contacting or rolling over upon the infant.

In each embodiment of the present invention, the device may be disassembled to a convenient and portable size. The device is adapted for inexpensive construction whereby the ultimate cost to the consumer will be reasonable. The device further is constructed of materials which are durable and which easily may be disassembled and laundered as appropriate.

Accordingly, it is an object of the present invention to provide an infant protective safety support device capable of constraining and supporting the infant child in a recommended sleeping position, while providing a means of warning a sleeping adult that (s)he is about to contact or roll upon the infant.

It is a further object of the present invention to provide an infant protective safety support device capable of awakening the sleeping adult before (s)he contacts or rolls upon the infant so as to prevent injury to the infant.

It is a still further object of the present invention to provide an infant protective safety support device capable of warning a sleeping adult that (s)he is about to contact or roll upon the infant, all without awakening the sleeping infant.

It is an additional object of the present invention to provide an infant protective safety support device capable of notifying an adult, who may not be present in the room, that the infant has awakened and is moving about.

It is another object of the present invention to provide an infant protective safety support device that will reliably create a protective barrier about an infant child when sleeping alongside of an adult.

It is another object of the present invention to provide an infant protective safety support device that will reliably create a protective barrier about an infant child when the child's diaper is being changed upon a bed or other flat surface.

It is still another object of the present invention to provide an infant protective safety support device that is safe and easy to use.

It is yet another object of the present invention to provide an infant protective safety support device that can be adjusted for use with infants of differing sizes.

It is yet still another object of the present invention to provide an infant protective safety support device that is portable.

It is another and further object of the present invention to provide an infant protective safety support device that is both durable and washable.

These and other objects, features, and advantages of the present invention will become more apparent to one skilled in the art by reference to the following detailed description of the preferred and alternate embodiments, the appended claims, and the accompanying drawings.

BRIEF DESCRIPTION OF THE DRAWINGS

The present invention will be better understood by reading the Detailed Description of the Preferred Embodiment with reference to the accompanying drawing figures, in which like reference numerals denote similar structure and refer to like elements throughout, and in which:

FIG. 3 is a top view of the infant protective safety support device of FIG. 1; and, FIG. 4 is a partial sectional view of the infant protective safety support device of FIG. 1 demonstrating both the audible warning device and the vibration producing device of the preferred embodiment of the present invention present invention.

DETAILED DESCRIPTION OF THE PREFERRED EMBODIMENT

Figure 1:
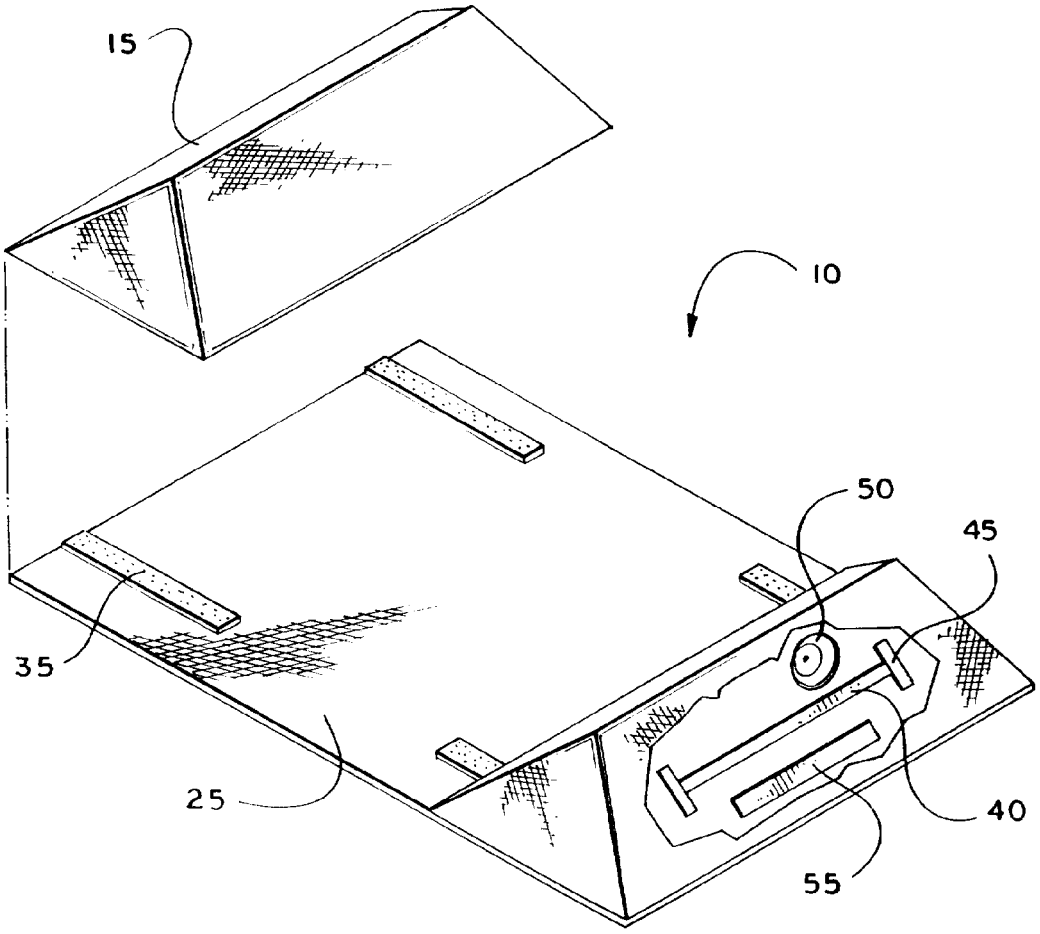
FIG. 1 is a perspective view of the infant protective safety support device, further having a cutaway demonstrating both the audible warning device and the vibration producing device, all as constructed in accordance with the preferred embodiment of the present invention.

In describing the preferred and alternate embodiments of the present invention illustrated in the figures, specific terminology is employed for the sake of clarity. The invention, however, is not intended to be limited to the specific terminology so selected, and it is to be understood that each specific element includes all technical equivalents that operate in a similar manner to accomplish a similar purpose.

Referring to FIGS. 1, 2, 3, and 4, the infant protective safety support device 10 of the present invention is shown fully assembled and in position for receiving an infant. The device 10 is comprised of a plurality of soft barriers 15, preferably of triangular cross-section, and preferably constructed of foam rubber or other suitable springing, non-rigid material. Each barrier 15 preferably is encased in fabric covering 20, which is generally sewn and shaped to conform to the size and shape of the assembled barrier. The fabric covering 20 is removably affixed to barrier 15 by zippers, by hook and loop fasteners, or by any other manner of affixation well known in the art.

Cutouts are provided within a side of each barrier 15 for insertion of microswitches 45. The cutouts are of sufficient size and shape to receive and capture microswitch 45 in an interference fit. Preferably, two microswitches 45 are utilized in each barrier 15, one near each end.

Upon each barrier 15, bridging the microswitches 45 in overlapping engagement is an activation bar 40, preferably of rigid plastic or similar material.

Additional cutouts are provided within a side of each barrier 15 for affixation of chime speaker 50, vibrating mechanism 55, battery 60, and electrical switch 65. It will be appreciated that electrical switch 65 is provided for converting between chime and vibration modes of operation. Again, each cutout preferably is of sufficient size and shape to receive and capture its cooperating element in an interference fit.

Although other components may be utilized without departing from either the scope or spirit of the the present invention, microswitch 45 may be of the type commonly referred to as a submini lever switch, having contacts rated 5 amperes at 125 volts a.c. Similarly, chime speaker 50 may be a magnetic-type buzzer having operating specifications of approximately 3.4 kilohertz at 12 volts d.c. Vibrating mechanism 55 may comprise a high speed motor operating between 9–18 volts d.c. Electrical switch 65 may comprise a submini slide switch having contacts rated at 0.3 amperes at 125 volts a.c.

Each fabric covering 20 preferably is suitably sized to encompass an entire barrier 15, including microswitches 45 and activation bar 40. Also provided is a fabric base 25 to which the barriers 15 may be removably attached. Affixed to the base of each barrier 15 are hook fasteners (not shown), each of which removably engages cooperating loop fastener strips 35 which is affixed upon the cloth base 25 of the device 10.

The device 10 is assembled as variously shown in the Figures. FIGS. 1 and 3 depict barriers 15 in their preferred locations upon fabric base 25. The spacing of barriers 15 along fabric base 25 may be adjusted to accommodate the size and position of a sleeping infant by moving barriers 15 along loop fastener strips 35 until the desired position is reached. The barriers then are pressed into position whereby the cooperating hook and loop fasteners are engaged.

Figure 2:
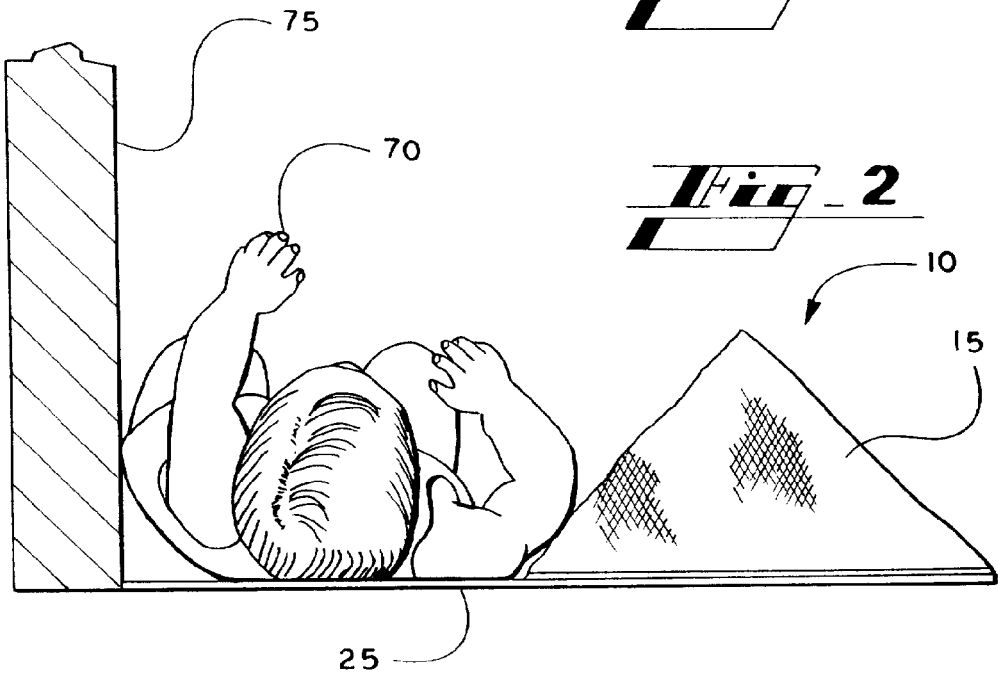
FIG. 2 is a side view of an alternate embodiment of the infant protective safety support device of FIG. 1 demonstrating an infant in an alternate position of resting against a barrier.

FIG. 2 demonstrates device 10 as used with a single barrier 15. In this Figure, a sleeping infant may be propped, for example, between barrier 15 and a wall 75. It will be appreciated, of course, that wall 75 may be a crib rail or the like.

FIG. 4 depicts a preferred arrangement of the preferred embodiment of device 10, demonstrating both the chime speaker 50 audible warning device and the vibrating mechanism 55 of the present invention. In this embodiment, operation of device 10 is enabled in either an audible tone or vibration mode. Alternate wiring configurations may be provided, as well known in the art, depending upon type and nature of warning indicator required.

In operation, the desired warning mode is selected by the parent through operation of electrical switch 65. In this regard, the parent may choose a vibrating warning mode, which will not typically awaken a sleeping child, an audible warning mode, or both.

In a first configuration, electrical switch 65 is set for audible warning. The barriers 15 are suitably positioned upon the fabric base 25 at a desired width, with the activation bars 40 adjacent the infant, and then the barriers 15 are pressed into position through alignment of the cooperating hook and loop fasteners. The width is determined according to the size of the infant and the position in which the parent desires the infant to sleep. In this manner, a partial enclosure is formed, into which the infant may be placed in order to restrict the movement of the infant, and, specifically, to restrain the infant from rolling and falling off of a bed or other flat surface.

When the infant starts to awaken and move about, it will contact the activation bar 40 adjacent one of the barriers 15; thereby, activating the chime speaker 50 and audibly notifying the adult that supervision is required. Although the infant generally is restrained between the barriers until the adult removes the infant from the device 10, the warning feature of the device assures the attentive parent that the infant is not left to thrash about upon the bed and work its way out of device 10. In this way, the safety of the child is better ensured.

In a second configuration, electrical switch 65 is set for either audible or vibrating warning. The barriers 15 are positioned such that the activation bars 40 face outwardly, away from the partial enclosure formed by the barriers 15. Again, the barriers 15 are suitably positioned upon the fabric base 25 at a desired width and the barriers 15 are pressed into position through alignment of the cooperating hook and lo op fasteners.

In this configuration, an adult sleeping or otherwise resting alongside of the infant will contact an activation bar 40 adjacent one of the barriers 15 when the adult rolls or moves toward the infant. The adult thereby will activate the warning indicators 50 and/or 55, and will awaken without contacting or rolling upon the infant.

The invention is not restricted to the above described design; rather, a number of modifications are possible within the scope of possible requirements. Barriers 15, for example, may be of varying sizes or shapes. Additionally, means for adjusting the volume of the chime speaker 50 audible warning device, or the extent of vibration of the vibrating mechanism 55, might also be provided. Further, an integrated unit, for example, comprising a battery, a microswitch, and at least one warning indicator, may be provided in a single cutout, rather than as separate components.

With regard to all such embodiments as may be herein described and contemplated, it further will be appreciated that optional features, including, but not limited to, aesthetically pleasing coloration and surface design, and labeling and brand marking, may be provided in association with the present invention, all without departing form the scope of the invention.

Having thus described exemplary embodiments of the present invention, it should be noted by those skilled in the art that the within disclosures are exemplary only and that various other alternatives, adaptations, and modifications may be made within the scope of the present invention. Accordingly, the present invention is not limited to the specific embodiments as illustrated herein, but is only limited by the following claims.

I claim:

1. A protective safety support for infants, comprising:

a barrier member, said barrier member further comprising a cutout for holding at least one warning means therewithin to indicated contact with the barrier member;

a sheet of sufficient size to removably affix said barrier member thereto, said sheet comprising an upper and a lower surface;

plurality of warning means held within said barrier member;

means for activating said plurality of warning means; and, means for detachably connecting said barrier member to said sheet.

2. The protective safety support of claim 1 comprising a cover removably enclosing said barrier member.

3. The protective safety support of claim 1 wherein said barrier member further comprises at least one substantially flat side.

4. The protective safety support of claim 1 wherein said plurality of warning means comprises at least one vibrating mechanism.

5. The protective safety support of claim 1 wherein said plurality of warning means comprises at least one audible alarm.

6. The protective safety support of claim 1 wherein said plurality of warning means comprises at least one audible alarm and at least one vibrating mechanism.

7. The protective safety support of claim 1 wherein said cutout is of sufficient size and shape to receive at least one of said plurality of warning means.

8. The protective safety support of claim 1 wherein said activating means comprises a switch.

9. The protective safety support of claim 8 wherein said activating means further comprises a substantially rigid member which is affixed adjacent said switch such that said switch is activated when said rigid member contacts said switch.

10. The protective safety support of claim 8 wherein said activating means further comprises means to enable the user to select between an audible warning and a vibrating warning.

11. The protective safety support of claim 1 wherein said detachable connecting means comprises cooperating hook and loop fasteners.

12. The protective safety support of claim 2 wherein said cover is fabric.

13. The protective safety support of claim 1 wherein said barrier member further comprises foam rubber.

14. The protective safety support of claim 1 wherein said barrier member is a plurality of barrier members.

15. The protective safety support of claim 1 further comprising an audible alarm.

16. A protective safety support for infants, comprising:

a barrier member, said barrier member further comprising a cutout for holding a vibrating mechanism therewithin;

a sheet of sufficient size to removably affix said barrier member thereto, said sheet comprising an upper and a lower surface;

a vibrating mechanism held within said barrier member;

a switch for activating said vibrating mechanism to indicate contact with the barrier member; and, means for detachably connecting said barrier member to said sheet.

17. A safety support for infants, comprising a barrier member; a fabric sheet of sufficient size to removably affix said barrier member thereto, said sheet further comprising an upper and a lower surface; a vibrating mechanism held within said barrier member; an audible alarm held within said barrier member; a switch for selectively activating said vibrating mechanism and said audible alarm to indicate contact with the barrier member; and, cooperating fasteners for detachably connecting said barrier member to said sheet.

* * * * *